US006095358A

United States Patent [19]

Marino

[11] Patent Number: 6,095,358

[45] Date of Patent: Aug. 1, 2000

[54] ANTI-CREEPING CAP FOR CONTAINER

[76] Inventor: Michael Marino, Route 422 West, R.R. 2, Box 2801, New Castle, Pa. 16101

[21] Appl. No.: 09/360,803

[22] Filed: Jul. 26, 1999

[51] Int. Cl.[7] ..... B65D 41/04

[52] U.S. Cl. ..... 215/330; 215/305

[58] Field of Search ..... 215/295, 302, 215/305, 330

[56] References Cited

U.S. PATENT DOCUMENTS

| | | | |
|---|---|---|---|
| 4,270,664 | 6/1981 | Buono . | |
| 4,345,691 | 8/1982 | Burke . | |
| 4,494,665 | 1/1985 | Lehmann . | |
| 4,664,273 | 5/1987 | Simon . | |
| 4,727,998 | 3/1988 | Simon . | |
| 4,991,733 | 2/1991 | Marino | 215/330 |
| 5,143,237 | 9/1992 | Lindsey et al. | 215/330 |
| 5,360,127 | 11/1994 | Barriac et al. . | |
| 5,552,117 | 9/1996 | Burns | 215/295 X |
| 5,685,445 | 11/1997 | Dobbs . | |
| 5,769,254 | 6/1998 | King et al. | 215/330 |

*Primary Examiner*—Stephen K. Cronin
*Attorney, Agent, or Firm*—Harpman & Harpman

[57] ABSTRACT

An anti-creeping cap to prevent the self unscrewing of a cap from a container used for edible products. The cap has an internal screw thread and multiple spaced engagement ribs extending from a secondary depending annular flange that correspondingly engaged to a number of registering projections extending from the neck finish of the container. Moderate torsional rotation input force is required to disengage the registering projections from grooves formed between the ribs which is accomplished by the flexation of the flange for cap removal.

6 Claims, 4 Drawing Sheets

ANTI-CREEPING CAP FOR CONTAINER

BACKGROUND OF THE INVENTION

1. Technical Field

This invention relates to closure caps and corresponding neck finishes for edible products and the like that due to the product's nature allows in some instances for a self-unscrewing of the cap during shipping and storage. This "cap creep" phenomenon is often due to the product's viscosity that penetrates between the interlocking screw threads and reduces the frictional co-efficient therebetween allowing the cap to unscrew, "creep" and become loose over time and handling.

2. Description of Prior Art

Prior art devices of this type have used locking means to prevent rotation of the cap from neck finishes or more typically have relied on tamper evident designs to keep the cap secured until open. Such tamper evident caps are not necessarily effective since some designs still allow for cap "creep" within the confines of the secondary engagement cap portion required to remove the cap. Such examples of the preceding caps can be seen in U.S. Pat. Nos. 5,360,127, 5,685,445, 4,727,998, 4,664,273, 4,494,665, 4,345,691 and 4,270,666.

In U.S. Pat. No. 5,360,127 a non-removable container closure can be seen having interlocking ratchet teeth on both the cap and the neck finish of the container. Once the cap is threaded onto the container and the teeth engage, you cannot remove it without breaking a portion of the cap.

U.S. Pat. No. 5,685,445 is directed to an anti-backoff removable closure for a container having interengaging ratchet teeth on cap and neck finish. The cap teeth have a trailing edge that will "cam" sufficiently out of engagement with the neck finish.

A tamper evident closure can be seen in U.S. Pat. No. 4,727,998 wherein a cap has a tear tab and a frangible strip connecting it to the cap. The tear tab, once removed, will allow for reverse rotation and removal of the cap.

U.S. Pat. No. 4,664,273 claims a child resistant container and closure means having a series of large and small grooves in the cap portion and selectively registering projections on the neck finish.

U.S. Pat. No. 4,494,665 on a device for preventing the self-unscrewing of a cap from a container is shown having a projection on the neck finish over which the lower end of a cap screw thread rides holding the cap more securely in place.

U.S. Pat. No. 4,345,691 claims a child resistant closure for a pump dispensing device wherein a series of ratchet teeth on the inside of the cap engage registering teeth on the closure preventing the cap from being removed from the container.

SUMMARY OF THE INVENTION

A removable semi-locking cap for edible products. The cap has a depending annular flange with an inside threaded surface and a second resilient annular flange depending therefrom having a plurality of spaced recesses separated by registration ribs for engagement with spaced projections on the neck finish of the container below the corresponding engagement threads. The interengaging projections and grooves prevent cap unscrewing "creep" while still allowing removal by imparting additional torsional rotational force by the deflection of the respective depending annular clap flange over other projections.

DESCRIPTION OF THE PREFERRED EMBODIMENT

Figure 1:
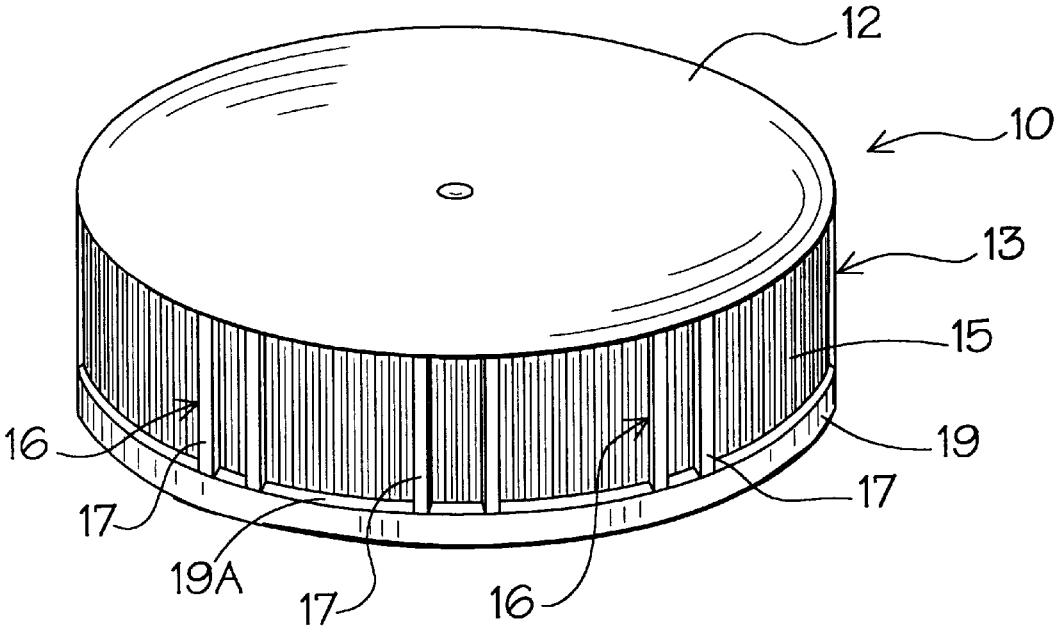
FIG. 1 is a perspective view of the closure of the invention.
Figure 3:
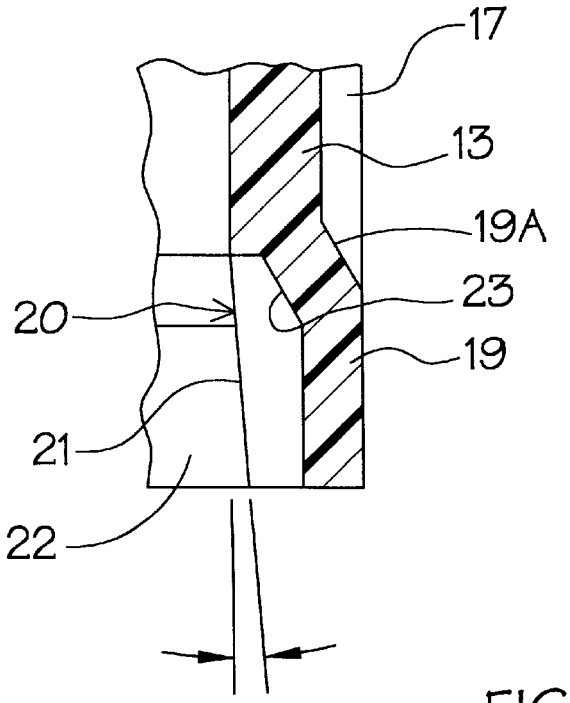
FIG. 3 is an enlarged partial cross-sectional view of the engagement groove portion of the closure.
Figure 2:
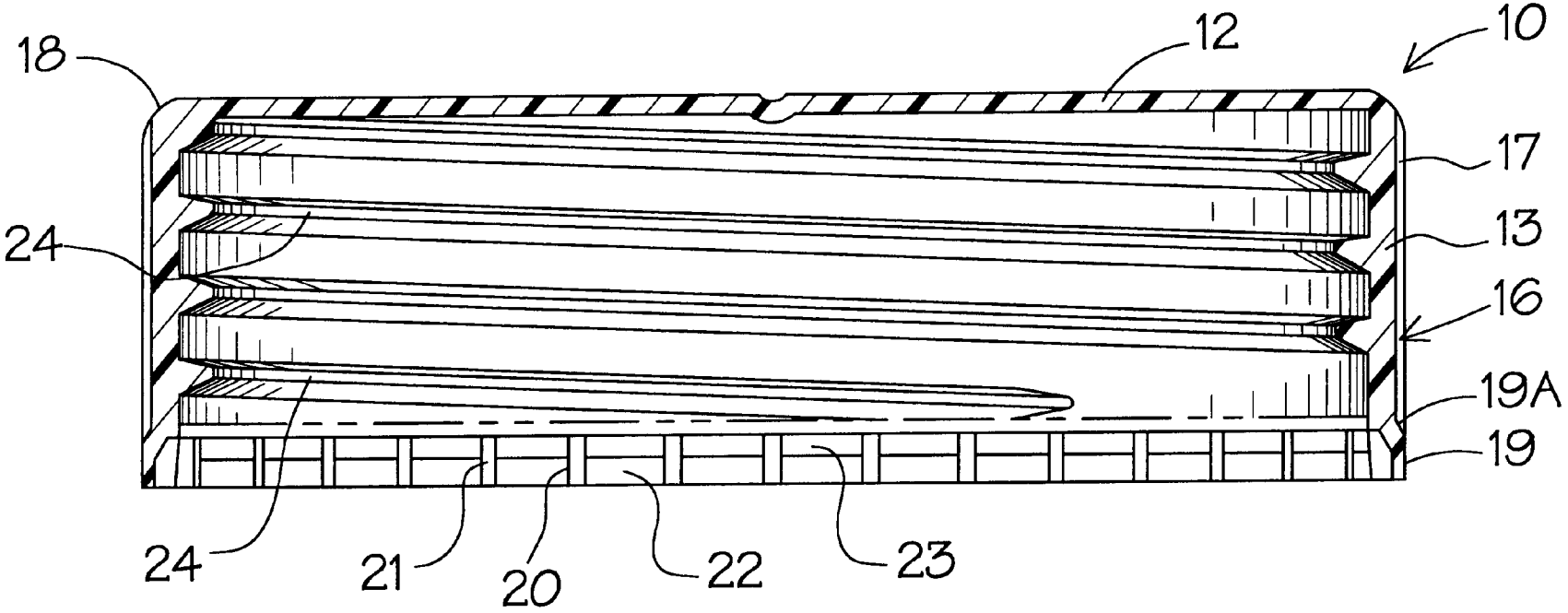
FIG. 2 is a cross-sectional view of the closure as seen in FIG. 1 of the drawings.
Figure 4:
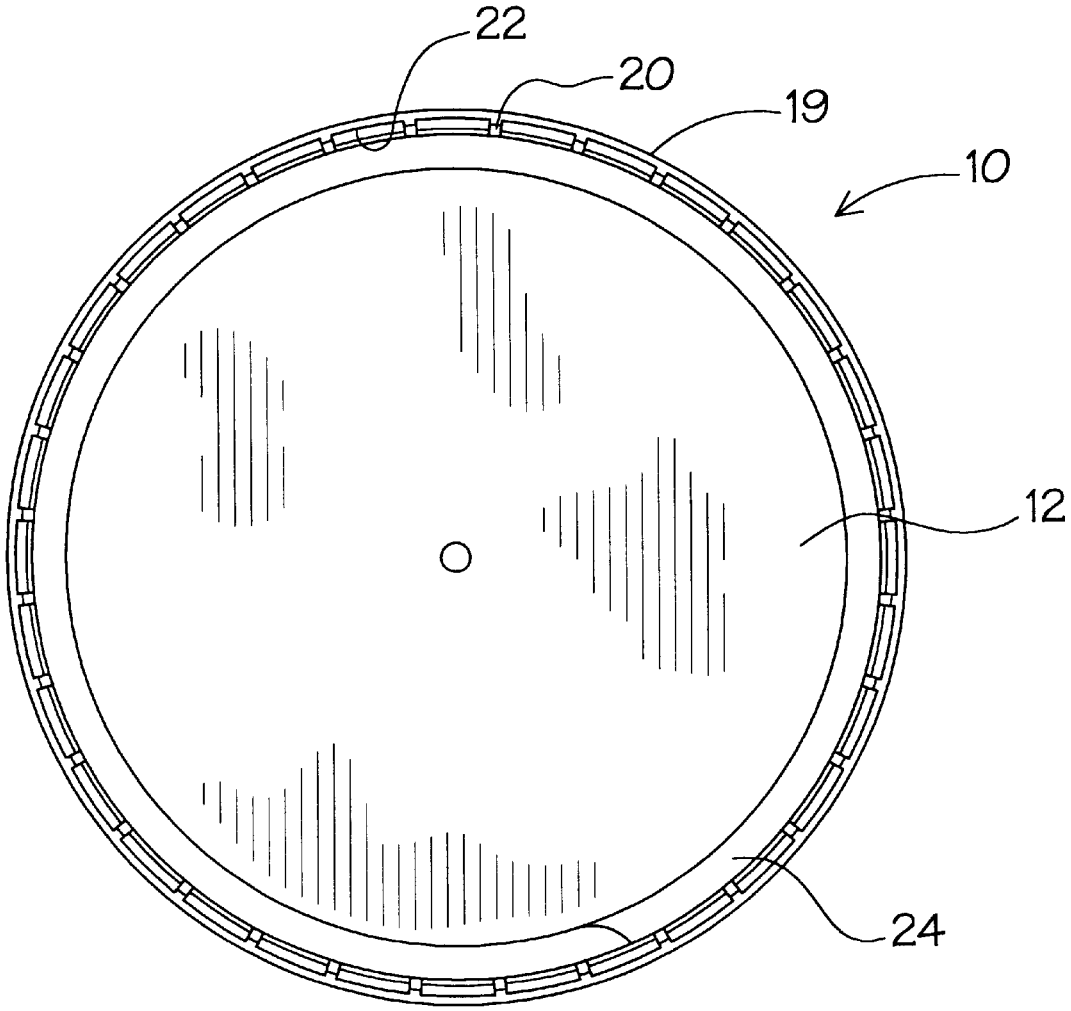
FIG. 4 is a bottom view of the closure of the invention.

A new and improved anti-creep cap 10 and cooperating container neck finish 11 can be seen in FIGS. 1–5 of the drawings. The cap 10 is characterized by a top portion 12 with a depending annular flange 13 extending integrally therefrom. The annular flange 13 is of a thin wall construction which imports flexibility thereto which is important to caps anti-creep features as will be hereinafter described. The external surface 14 of the annular flange has a vertically aligned texturing at 15 with multiple pairs 16 of parallel annularly spaced engagement ribs 17. The rib pairs 16 extend from a perimeter edge 18 of the top portion 12 to a secondary depending annular flange 19 of an increased radius over that of said first annular flange 13 from which it depends. The flange 19 has a transitional area between the first and second flanges at 19A, best seen in FIG. 3 of the drawings. The annular flange 19 has a plurality of inwardly extending vertically aligned ribs 20 which are in spaced annular relationship to one another having a tapered outer engagement surface 21. The ribs 20 define a like number of engagement grooves 22 therebetween. The engagement grooves 22 each have in cross-section a vertical rear surface portion 23 and a angular interconnecting portion 24 of approximately thirty degrees from the vertical. The ribs 20 and respective grooves 22 form the anti-creep portion of the cap 10. A spiral thread 24 extends from an inner surface 25 of the annular flange 13 for engagement with the neck finish 11.

Figure 5:
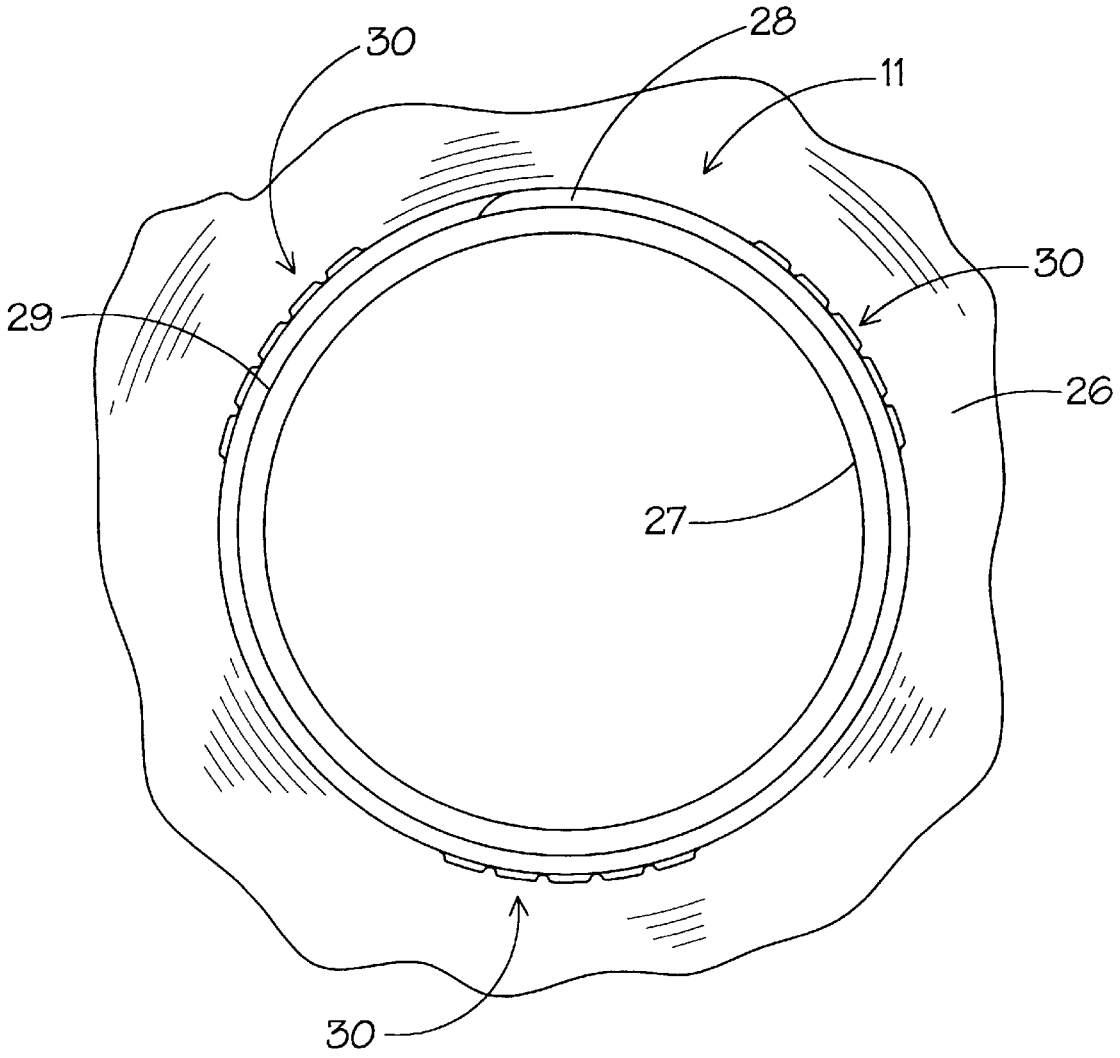
FIG. 5 is a top plan view of the neck finish of the invention.

Referring now to FIG. 5 of the drawings, the neck finish 11 can be seen on a container 26 having a neck portion 27 defining an opening therein. A spiral thread 28 is formed on the exterior surface 29 of the neck portion 27 for registration with the hereinbefore described interior cap threads 24. A series of registration projections 30 extend from the exterior surface of the neck portion 27 in spaced multiple groupings indicated at 31. Each of the projections 30 are of an registering dimension equal to that of the respective engagement grooves 22 the projections each have oppositely disposed inclined surfaces of equal angular disposition.

In operation, the cap 10 is threadably engaged on the neck finish of the container 26 by the interengagement of the respective cap and neck threads 24 and 28 drawing the annular flange 19 into contact with the group of projections 30 on the neck portion 29. The projections 30 are accordingly engaged within the respective aligned grooves 22 in the annular flange 19 which is flexed as the ribs 20 ride over the projections 30 on their respective tapered surfaces 21.

Once the cap 10 is seated on the neck portion 29 sealing the container 26 the engagement projections 30 will keep the cap in an anti-creeping, unthreading status, maintaining a seal therebetween. To open the container 26, the cap 10 is simply rotated counter-clockwise with the ribs 20 being forcibly deflected over the projections at 30 in reverse to the closing action as hereinbefore described.

As noted, the thin wall of the annular flange 19 will flex and deform allowing the cap 10 and its internal ribs 21 to pass over the respective fixation projections at 30 allowing for the unscrewing and removal of the cap 10 from the container 26.

The rib pairs 16 on the external surface 14 of the cap not only provide a gripping surface in combination with the textured surface 15 thereabout, but also act to increase torsional stability without impairing the rotational flexibility thereof.

Thus it will be seen that a new and novel anti-creep closure system and neck finish has been illustrated and described and that it will be apparent to those skilled in the art that various changes and modifications may be made therein without departing from the spirit of the invention.

Therefore I claim:

1. A combination including a container and a removable rotatable closure thereon that resist unassisted loosening, said container having a neck finish defining an opening therein, said closure having a top portion, a depending annular flange on said top portion, an engagement annular flange extending outwardly from said depending annular flange, a plurality of inwardly extending annularly spaced ribs on said engagement flange, inner engagement grooves between said respective ribs, transition means between said respective annular flanges, said ribs having a tapered front surface extending from an inter-surface of said depending annular flange, reinforcing and surface engagement means on said first annular flange, a plurality of annularly spaced identical engagement projections in annularly spaced groups about said neck finish, each of said projection registerably with said respective interengagement grooves on said engagement flange, said projections having oppositely disposed opposing angularly inclined equal surfaces.

2. The container and closure combination set forth in claim 1 wherein said engagement flange is of a known diameter greater than that of said depending annular flange.

3. The container and closure combination set forth in claim 1 wherein said transition means between said respective annular flanges comprises, an angled surface portion of a back surface of said interengagement grooves in said engagement flange.

4. The container and closure set forth in claim 1 wherein said reinforcing and surface engagement means on said first annular depending flange comprises; multiple pairs of parallel annularly spaced engagement ribs with a textured grippable surfaces therebetween on the exterior surface of said first annularly depending flange.

5. A container neck finish and a removable closure positionable thereon comprising, a closure having a top portion, a depending annular flange extending from said top portion, an engagement annular flange extending outwardly from said depending annular flange, a plurality of inwardly extending annularly spaced ribs on said engagement flange, said ribs having a tapered front surface extending from an inner surface of said depending annular flange, a plurality of annularly spaced identical engagement projections in annularly spaced groups about said neck finish, each of said projections registerable within said respective inner engagement grooves on said engagement flange, said projections having oppositely disposed opposing annular inclined equal surfaces, a transition surface between said depending annular flange and said engagement flange, said engagement flange is of a known diameter greater than that of said depending annular flange.

6. The container and neck finish and removable rotatable closure set forth in claim 5 further comprises, multiple pairs of parallel annularly spaced engagement ribs with textured grippable surfaces therebetween on the exterior surface of said first annularly depending annular flange.

* * * * *